United States Patent [19]

Eie

[11] Patent Number: 4,938,632

[45] Date of Patent: Jul. 3, 1990

[54] TENSION LEG PLATFORM AND METHOD FOR INSTALLATION OF THE SAME

[75] Inventor: Rolf Eie, Osterås, Norway

[73] Assignee: Norwegian Contractors A/S, Stabekk, Norway

[21] Appl. No.: 314,411

[22] Filed: Feb. 22, 1989

[30] Foreign Application Priority Data

Feb. 24, 1988 [NO] Norway ..... 88.0806

[51] Int. Cl.[5] ..... B63B 35/44

[52] U.S. Cl. ..... 405/224; 405/195; 405/204; 114/265

[58] Field of Search ..... 405/224, 195, 196, 204; 114/265, 264

[56] References Cited

U.S. PATENT DOCUMENTS

| | | | |
|---|---|---|---|
| 3,490,406 | 1/1970 | O'Reilly et al. | 405/224 X |
| 3,955,521 | 5/1976 | Mott | 405/224 X |
| 3,982,492 | 9/1976 | Steddum . | |
| 3,996,755 | 12/1976 | Kalinowski | 405/224 X |
| 4,364,323 | 12/1982 | Stevenson | 114/265 |
| 4,468,157 | 8/1984 | Horton | 405/224 |
| 4,540,314 | 9/1985 | Falkner | 405/224 X |
| 4,775,265 | 10/1988 | Calkins et al. | 405/224 X |
| 4,784,529 | 11/1988 | Hunter | 405/227 |

FOREIGN PATENT DOCUMENTS 2066191 7/1981 United Kingdom .

*Primary Examiner*—Dennis L. Taylor
*Attorney, Agent, or Firm*—Ladas & Parry

[57] ABSTRACT

A tension leg platform for drilling and/or production, processing and transporting hydrycarbons from sub sea wells or installations, and methods for installation of such platform. The platform comprises in operational position the following: a working platform which has position above the sea level, a buoyant body (1) which is connected with the underside of the platform and has substantially position below the surface, and a number of tension legs (13) which connect the buoyant body (1) with a fundament anchored to the sea bed. The invention is characterized in that the lower parts of the tension legs (13) in per se known fashion are anchored to the fundament (14) and at their upper ends are controlled in guides (20, 21) on the outside of the buoyant body and are attached to the buoyant body (1) above or just below the water line.

11 Claims, 13 Drawing Sheets

TENSION LEG PLATFORM AND METHOD FOR INSTALLATION OF THE SAME

Figure 1:
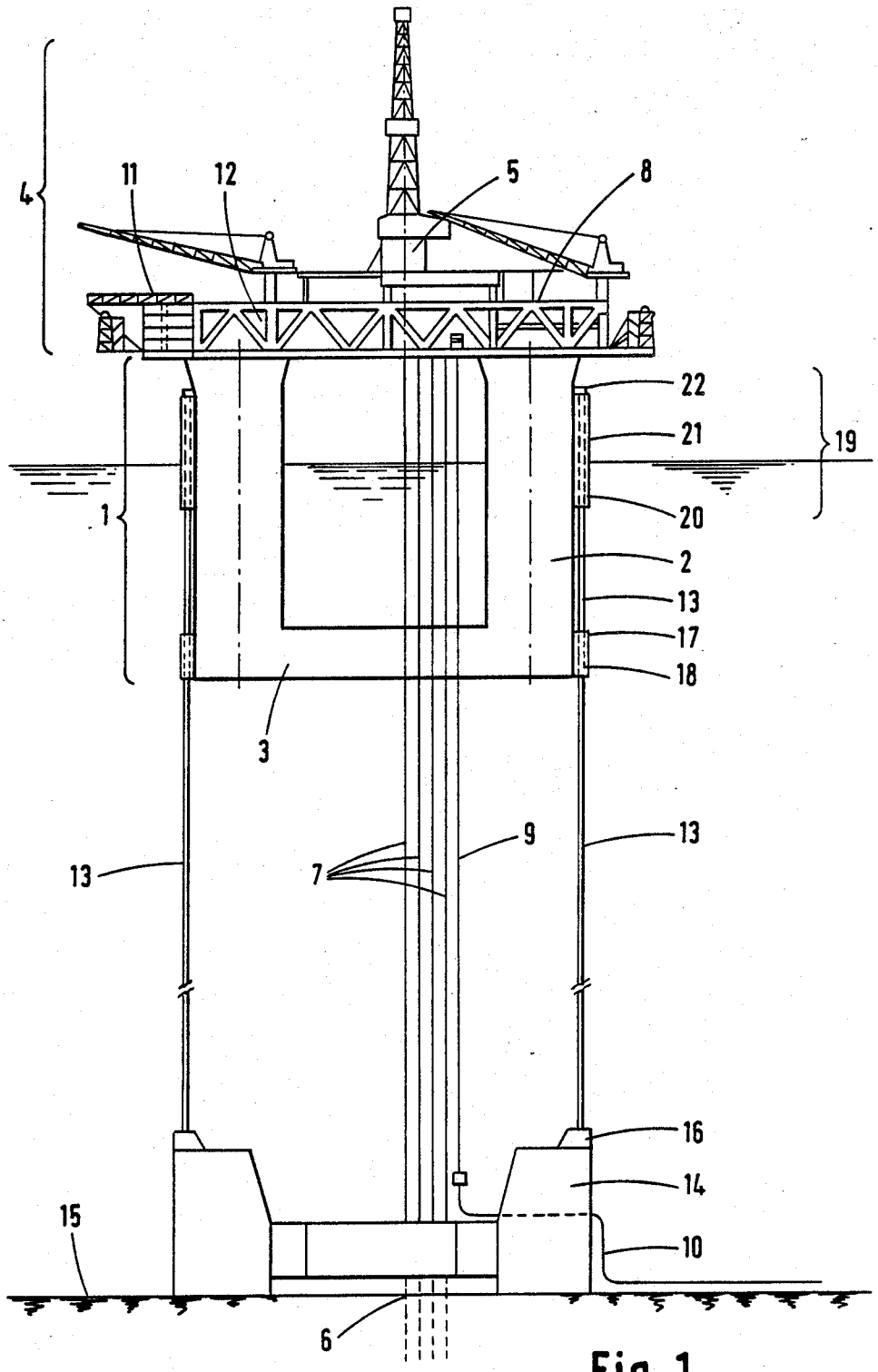

The present invention relates to a tension leg platform and a method for installation of such platform. The tension leg platform can be of a type designed for drilling, production, processing and transport of hydrocarbons from sub sea wells or installations. The platform is particularly, but not exclusively, adapted for operation on large sea depths.

Tension leg platforms are earlier known and are today utilized for production of hydrocarbons from sub sea wells or the like. Such platforms consist generally of a semi-submersible buoyant body which floats on the surface and which by means of its own buoyancy supports a platform deck. On the deck is positioned equipment for drilling, production and for processing of hydrocarbons or the like. The deck supports also riser pipes connecting the production equipment on the deck with wells and/or pipelines, and possibly other equipment positioned on the sea bed. The buoyant body is drawn down into the water by means of tension legs which are subjected to tension and which at their lower end are anchored to a fundament positioned on the sea bed. The pulling down of the buoyant body is accomplished to reduce vertical movements of the buoyant body when the same is subjected to environmental loads, such as waves. Thereby is established a substantially constant distance between the deck and the sea bed. The tension legs are anchored to the sea bed by means of for instance one or several fundaments. At their upper end the tension legs are anchored to the lower edge of the buoyant body by link connections. Links are utilized in corresponding fashion at the attachment point or points on the fundament. The fundament can be in the shape of a weight positioned on the sea bed, or in the shape of poles pressed down into the sea bed or a combination of the beforementioned embodiments.

Tension leg platforms consist therefore of the following main parts:

A buoyant body provided with a deck with equipment, possibly including riser pipes extending between the deck and equipment on the sea bottom, tension legs extending between the buoyant body and a fundament on the sea bottom, and a fundament.

The above mentioned three main parts traditionally have been made as welded steel structures wherein the tension legs have consisted of steel piping with threaded connections in the joints. The fundament and the buoyant body have in addition been proposed made in concrete.

Recent developments have shown that there exist rather large cost savings when making the buoyant body in concrete. The conventional tension leg system made of steel is however still the dominating cost element, particularly the expenses arising in connection with installation of the same.

The conventional tension leg platform is produced by making a fundament plate member ashore and transporting the same to the installation site where the fundament plate is submerged down to the sea bed and is secured, for instance by means of weight elements and/or poles. The buoyant body and the deck is made on or along the shore and is assembled in a suitable site, and is thereafter towed out to the installation site. The tension legs are made of piping which by welding is provided with couplings in the ends such that the pipe sections can be threaded together. The piping is for this purpose provided with necessary components in order to form an elongated tension leg with sufficient length.

During the towing operation to the installation site the pipe elements are conventionally stored as separate units, for instance positioned inside the columns of the buoyant body and/or the platform deck. Inside said columns is further installed or provided equipment in order to handle pipe sections and elements threaded together, and further equipment for threading pipe sections together into longitudinal tension legs, submersion of the same and further equipment for subjecting the tension legs to tension during the last phase of the installation of the buoyant body above the fundament. In the installation phase the position of the buoyant body above the fundament is secured while the desired number of tension legs are assembled together by threading together sections of the piping and which thereafter are past down through guides in the buoyant body for subsequent coupling to the fundament positioned on the sea bed. When a sufficient number of tension legs are coupled to the fundament, the legs are tensioned towards the buoyant body in order to provide the tension effects. The remaining tension legs can thereafter be installed.

The present invention relates to the design of the tension legs, the assembly of same, and methods and equipment for accomplishing the coupling thereof to the buoyant body and the fundament. A further object of the invention is to provide a new method for accomplishing the assembling of the tension legs to the buoyant body. A further object of the present invention is to provide a solution to the problem of providing protection of the tension legs, particularly in the surface or wave zone.

In accordance with the present invention the tension legs are preferably entirely assembled on shore into lengths which are suitable for the sea depth on the site where the platform operates. On this site each tension leg is provided with the necessary end fittings and is also given a surface treatment, whereafter the legs are transmitted to a horizontally floating condition outside the assembly site. The tension legs are thereafter towed out to the installation site in a position close to, or into, the sea surface and with the longitudinal axis of the tension legs extending substantially horizontally. In this phase the buoyant body is positioned ready to receive the tension legs on the installation site. The legs are transferred from a horizontal position at the sea surface to a vertical position down through the sea in that one end of the legs are moved down to the fundament by means of a cable and/or by ballasting. Said cable may for instance extend from one end of the leg down to a guide means on the fundament and therefrom up to for instance a winch positioned on the buoyant body. When one end of the tension leg has been drawn down to the fundament, this end is coupled to the fundament and is fixed thereto, whereafter the opposite end of the tension leg is drawn into the buoyant body and is fixed thereto. Until the upper end of the tension leg has been guided into position between protectional means arranged on the outside of the buoyant body and has been anchored to the buoyant body, the buoyant body may still move vertically. The tensioning of the tension legs can be carried out for instance by means of hydraulic cylinders. One may further subject the buoyant body to a deballasting having as a result that the tension in the tension legs will increase. Through controlled supply of hydraulic fluids to the cylinders vertical movements of the buoyant body will cease and the buoyant body may in a slow, controlled fashion be brought into contact with permanent load transmitting means positioned on the tension legs.

The remaining tension legs are mounted in the same fashion as described although with the simplification that the buoyant body now undergoes a negligible vertical movement, a fact which greatly simplifies the load transmittance. When all legs are in position and have been tensioned, protectional panels are mounted on the outside of the upper part of the tension legs and on the outside of the buoyant body. The need for such protectional panels are stipulated on basis of the probability for possible damage on the legs, for instance due to ship collision. The solution in accordance with the present invention will be less expensive than known solutions. Through the invention it will further be easier to replace tension legs. The fact that the tension legs in accordance with the invention are full-welded together, also reduces the risk for water penetration into the hollow space in the tension legs. Also the risk for fatigue failures in the goods is reduced simultaneously as dimensional control during the production will be simplified. The solution further reduces the need for equipment provided on the deck and inside the buoyant body. Furthermore surface treatment of the tension legs is much easier. Finally, the safety of the platform is increased since no guides or the like extend up through the buoyant body which is designed for receiving the tension legs. Further, the tension legs will be subjected to less environmental loads from the buoyant body by attaching the tension legs on the outside of the buoyant body and thereby being positioned at a longer distance from the center of the buoyant body.

Inasmuch as the tension legs are discontinued above the sea surface they can be inspected inwardly by means of equipment which can be lowered down into the same from the top of the legs. Finally, the tension legs can be replaced without complications, and replacement can be carried out without discontinuing the normal operation of the platform.

A general object of the present invention thus is to contribute to that exploitation of offshore oil and gas fields can be carried out by means of tension leg platforms in a less expensive and safer fashion.

Figure 2:
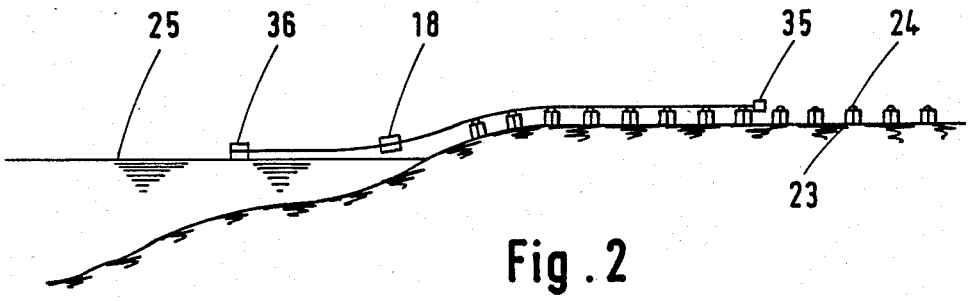
Figure 3:
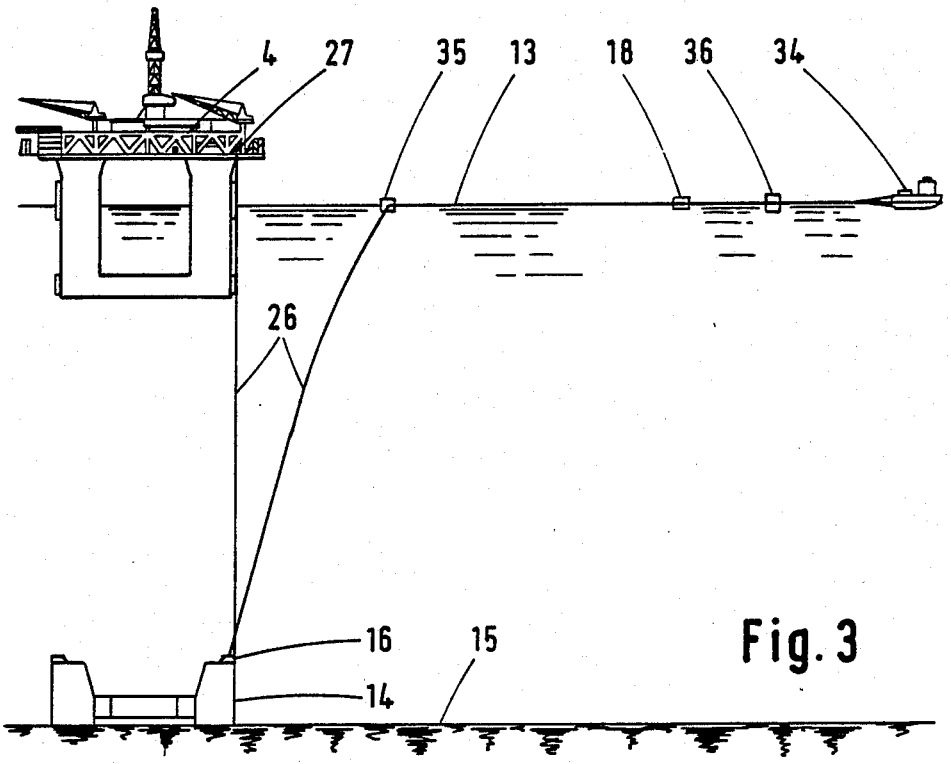
Figure 4:
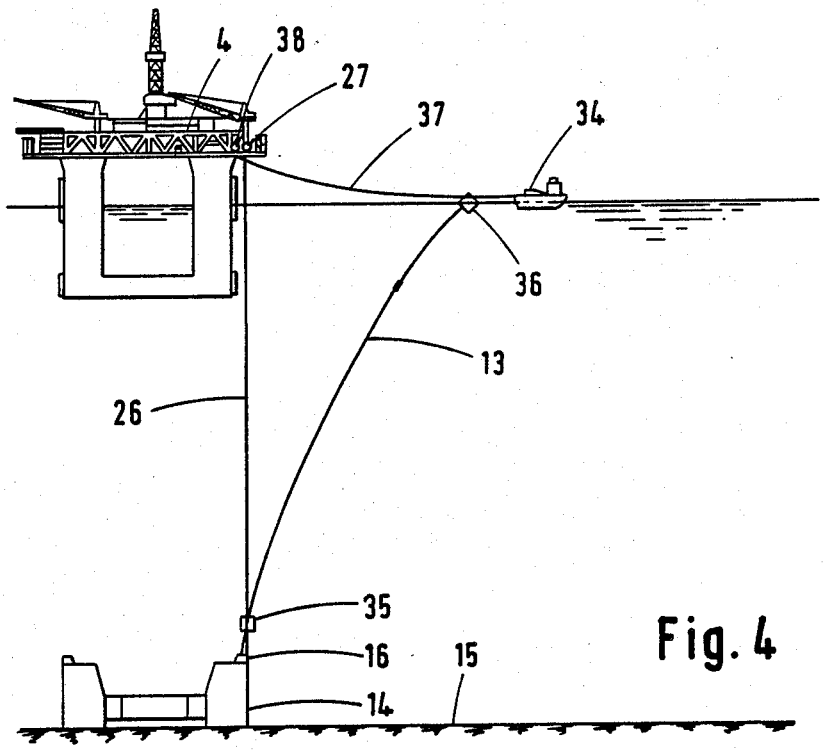

The invention shall be further described in the following with reference to the accompanying drawings, wherein:

FIG. 1 shows an elevation of a complete tension leg platform in accordance with the invention, wherein the fundament is composed of a gravitation anchor, FIG. 2 illustrates the launching of a readily made tension leg, FIG. 3 shows a tension leg in floating condition wherein the tension leg is in the first phase of the installation, prior to that one end of the leg is drawn down towards the fundament by means of a cable, FIG. 4 shows the tension leg partly moved down.

Figure 5:
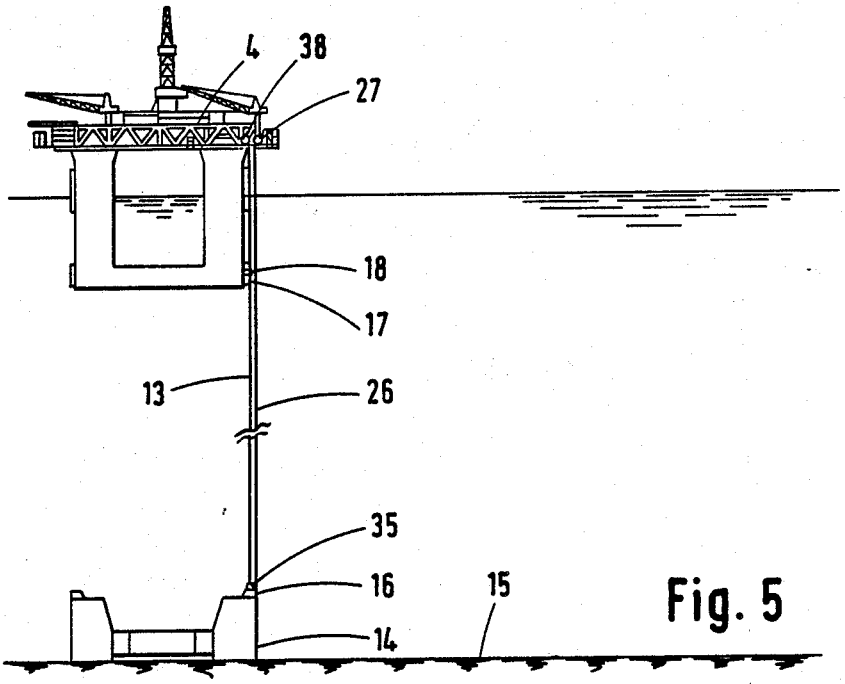

FIG. 5 shows the tension leg in substantially vertical position just before it shall be coupled to the fundament.

Figure 6:
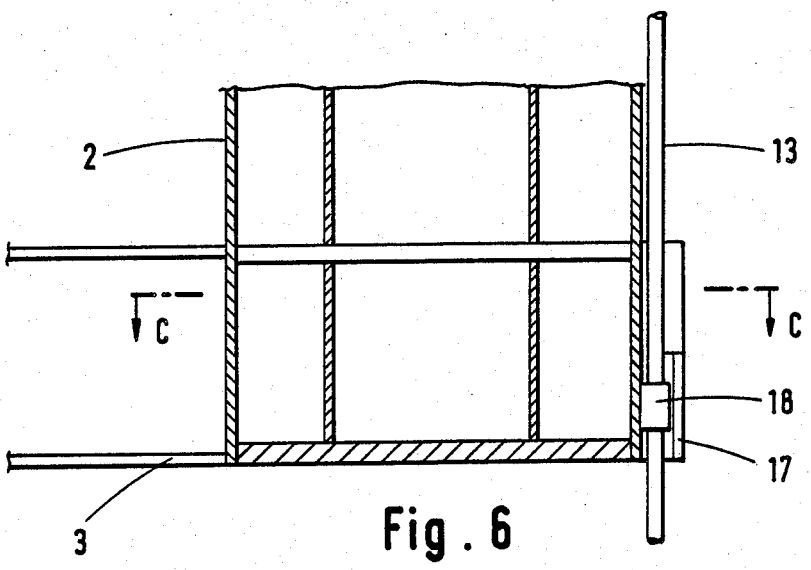
Figure 7:
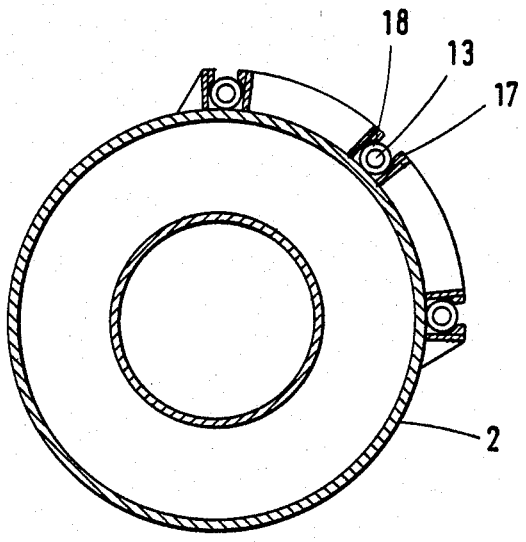
Figure 8:
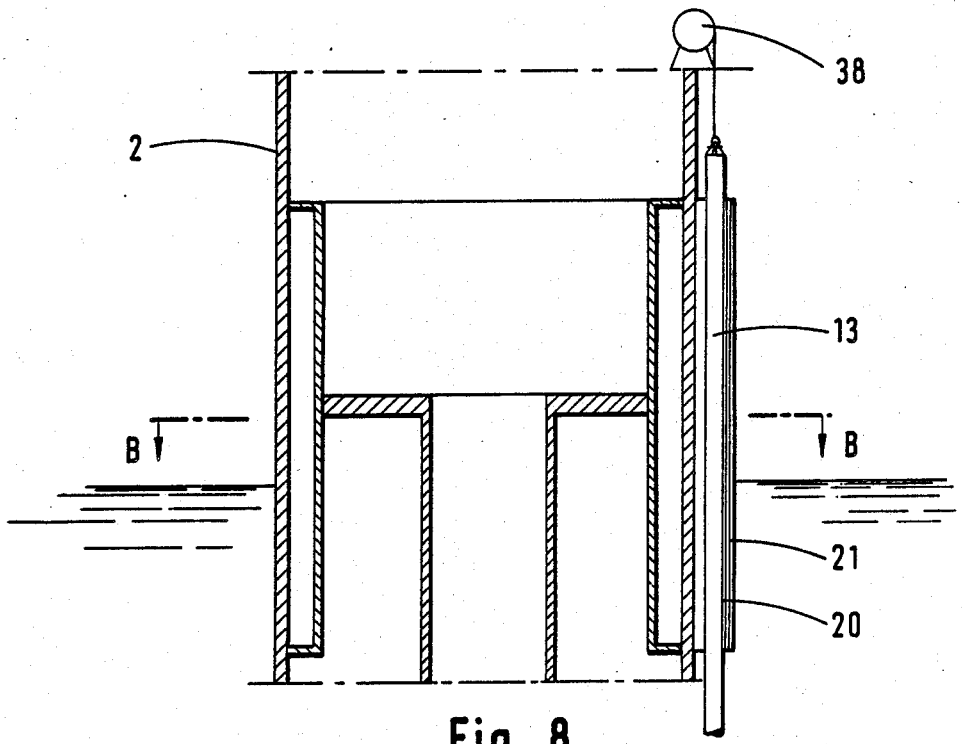
Figure 9:
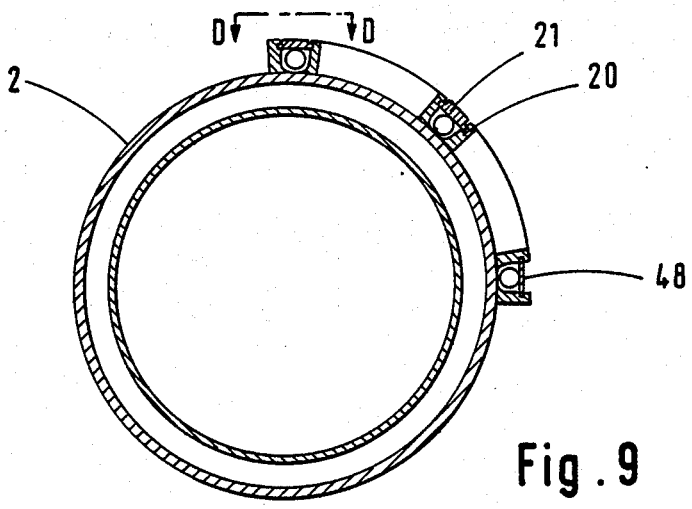
Figure 10:
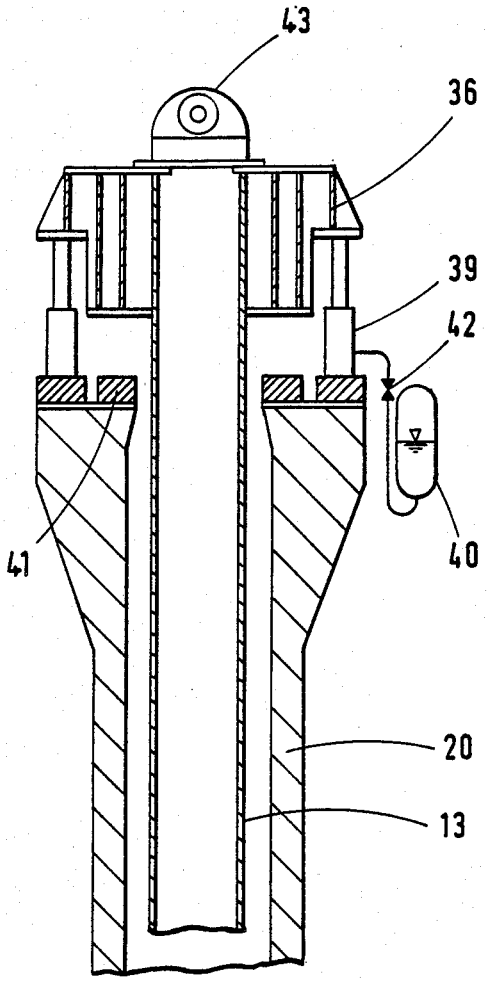
Figure 11:
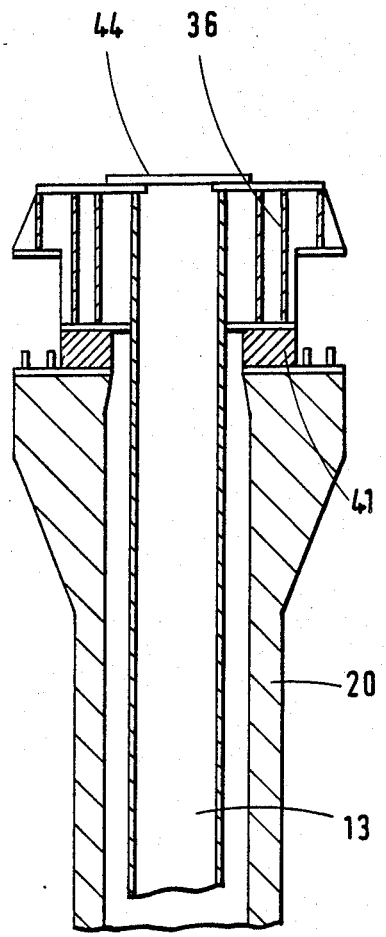
Figure 12:
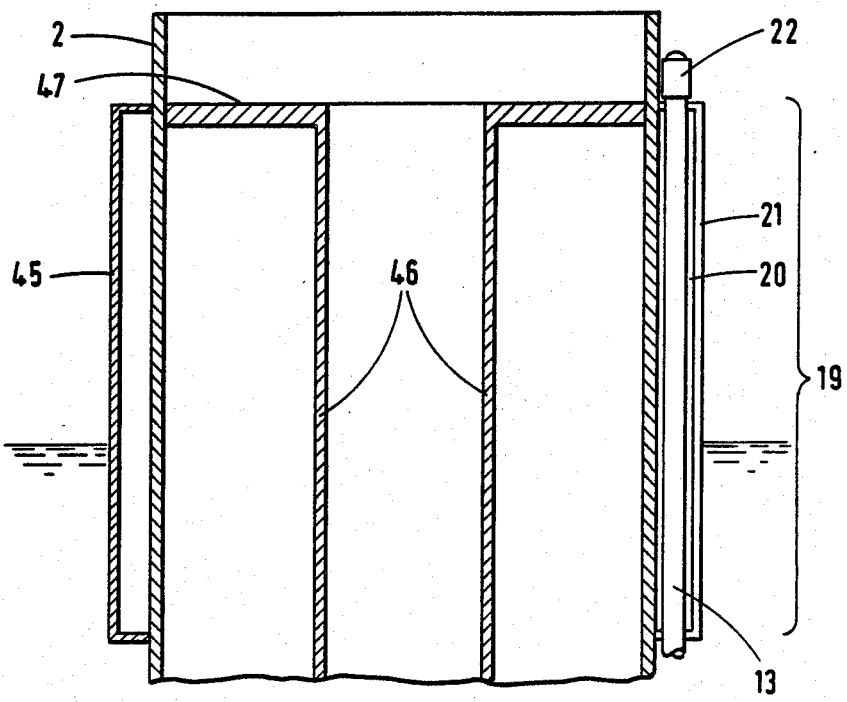
Figure 13:
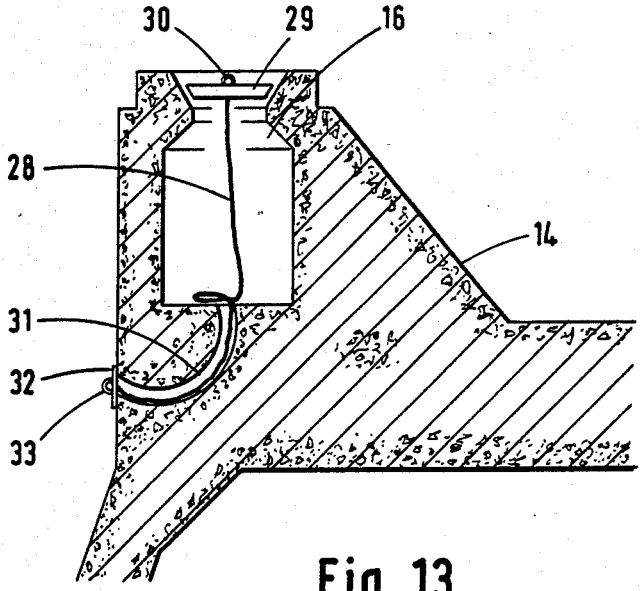
Figure 14:
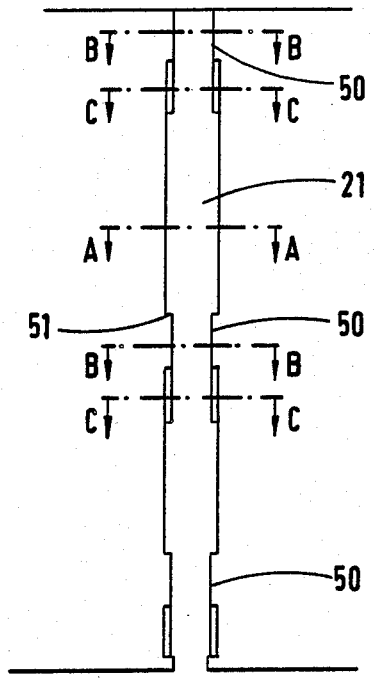
Figure 15:
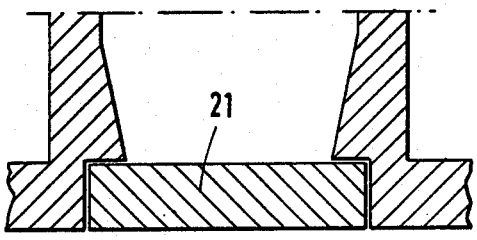
Figure 16:
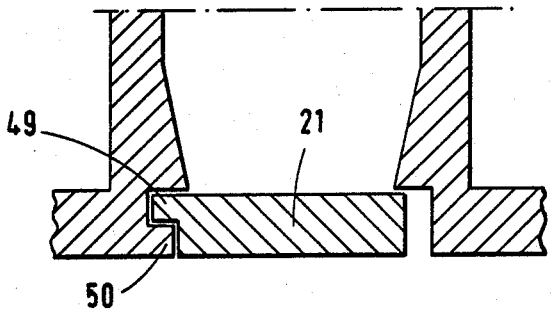

FIG. 6 shows a schematic fragmentary vertical section through a preferred embodiment of the attachment of the tension leg at the bottom of the buoyant body, FIG. 7 shows a horizontal sectional view along the line C—C in FIG. 6, FIG. 8 shows a fragmentary vertical section through the buoyant body in the wave zone with the tension leg in installation position, FIG. 9 shows a horizontal sectional view along the line B—B in FIG. 8, FIG. 10 shows a fragmentary sectional view of a possible alternative embodiment of the tensioning arrangement for the tension leg, FIG. 11 illustrates the tension leg in finalized tensioned and secured position on the buoyant body, FIG. 12 illustrates an alternative arrangement of the space compartments of the buoyant body which facilitates a larger degree of protection of the tension legs in the wave zone, and FIG. 13 illustrates a possible arrangement for guiding the pulling cable through the tension leg coupling at the fundament, wherein said coupling is of the in situ placement type, FIG. 14 is a schematic elevation illustrating the panel 21, along the line D—D in FIG. 9, FIG. 15 shows a section along line A—A in FIG. 14, and FIG. 16 fragmentary schematic sections along the lines B—B and C—C, to the right and left, respectively, as shown in FIG. 14.

The tension leg platform in accordance with the invention comprises a semi-submersible buoyant body 1, comprising columns 2 and pontoons 3. The shown buoyant body 1 supports a deck 4 whereon is positioned drilling equipment 5 for drilling production wells 6, and/or equipment for production of hydrocarbons through riser pipes 7, equipment 8 for processing hydrocarbons, riser pipes 9 for transport of hydrocarbons through a pipeline 10, a dwelling quarter 11, and other necessary facilities 12. The buoyant body 1 is anchored and partly pulled down into the sea by means of a number of tension legs 13 attached to the columns 2 on the buoyant body 1 and to the fundament 14 positioned on the sea bed 15. The position of the fundament 14 on the sea bed 15 can be secured by means of the own weight of the fundament and/or poles (not shown), driven down into the sea bed 15. The tension legs 13 are attached to the fundament 14 by means of couplings 16, which are designed to sustain both horizontal and vertical loads from the tension legs 13. The tension legs 13 are kept subject to tension in that the buoyant body 1 has greater buoyancy than the sum of the weight of the buoyant body as such and the weight of the deck 4 including all equipment and facilities supported thereon. The tension legs 13 are maintained in position adjacent the columns 2 by means of guides 17 which secure that the upper tension leg link 18 is kept in position adjacent the columns 2. The guides 17 and the link 18 constitute therefore the horizontal support or bearing of the buoyant body 1. The tension leg 13 is protected in the wave zone 19 by means of ribs 20, and if necessary, by panels 21, versus possible shock or bumps from vessels (not shown). Vertical forces in the tension legs 13 are transmitted to the columns 2 through the support anchoring 22.

The tension legs 13 are produced ashore 23 and are stored horizontally with ready mounted end couplings 35, 36 and links 18 and with applied surface treatment. The tension legs 13 can be made in materials such as full-welded steel piping or of synthetic materials such as "Kevlar". The tension legs 13 are for instance conveyed, one after the other, to for instance rollers 24 and are transported on the same out into the sea 25 or onto a barge (not shown), wherein it will float in surface position or at a preset depth, by means of own buoyancy, possibly with mounted buoyant bodies (not shown) if the tension legs 13 are not designed for independent flotation. The tension legs 13 thus can be stored preliminary in a protected fjord environment in floating condition if this is necessary.

The tension legs 13 are towed out to the installation site of the platform where the buoyant body 1 is ready for receiving the legs 13. The method for installation of the legs is shown in FIGS. 3–5. In the shown example the tension legs 13 have positive buoyancy. In order to install the tension legs a cable 26 is on beforehand pulled from the column 1 down to the end of the tension leg 13, where the cable is attached. The opposite end of said cable 26 is wound up on a winch drum 27 serving as pulling and tensioning device for the cable. Said winch 27 can be positioned on the deck 4.

A possible embodiment of the coupling 16 for the said cable 26 on the fundament is shown in FIG. 13. An already installed cable 28 is attached to a cover 29 by means of a ring 30, which cable 28 extends through a guide pipe 31 in the fundament to a lock 32 provided with a ring 33. By means of a submarine vessel the cable 26 can for instance be coupled to the ring 33 whereafter the lock 32 is released. By means of the submarine vessel a second cable can also be attached to the ring 30 and the cover 29 is pulled up to the column 2.

A vessel can be used for attaching the cable 26 to the lower coupling 35 of the tension leg down against the coupling 16 on the fundament 14. The coupling can be a collet connector or a side entry connector (not shown). This procedure is shown in FIG. 4. Just before the lower connection 35 on the tension leg 13 arrives down to the coupling 16 on the fundament 14, the cable 37 is attached thereto. This cable extends from a winch drum 38 to the upper connection 36 on the tension leg, which cable 37 is used for pulling the tension leg 13 into correct position adjacent the column 2. This last phase of the installation is illustrated in FIG. 5. The winch 38 is now used for tensioning the tension leg 14 in vertical position.

If the tension leg 14 is equipped with preliminar supplementing buoyancy vessels, the installation procedure necessarily will be somewhat different. In this case the towing vessel 34 in this case will pull the lower connection 35 on the tension leg 13 while the upper connection 36 on the tension leg will be attached to the winch 38 by means of cable 37. Thus the tension leg 13 will be kept subject to tension while the buoyancy vessels are removed from the tension leg. The lower connection 35 of the tension leg is pulled down by means of the cable 26. The method results in the same positioning as illustrated in FIG. 5. From this position the lower connection 35 on the tension legs are pulled down into the coupling 16 by means of cable 26 and is locked to the fundament. During this downward pulling operation the upper link on the tension leg has adapted itself in the guide 17 (FIG. 6), which guide 17 is provided with an opening or slit for the tension leg 13 in the lower part of same and is for this purpose given a somewhat larger opening further up for horizontal passage of the upper link 18 into the guide 17. The tension leg 13 thus is prevented from horizontal movement relative to the lower part of the column 2. This is also illustrated in FIG. 7.

FIG. 8 shows a vertical section through the column 2 of the buoyant body with the tension leg 13 in correct position between the ribs 20. The winch 38 is still maintaining the tension leg 13 under tension. In order to lock the tension leg 13 in correct position, a locking plate 48 is lowered down along grooves in the ribs, whereby the tension leg 13 is secured preliminary in correct position. This situation is also illustrated in FIG. 9. In this phase the buoyant body 1 may undergo vertical movements when subjected to wave actions simultaneously as the said ribs and the locking plate will prevent the tension legs from moving horizontally relative to the buoyant body. Readily installed hydraulic cylinders 39 shown in FIG. 10, which are connected to pressurized vessels 40, are now coupled against the upper connections 36 of the tension leg. The said cylinders 39 are pressurized and will thereby subject the tension leg 13 to tensioning forces. When a sufficient number of tension legs 13 have arrived into this position on each column, the deballasting procedure of buoyant body 1 is initiated by pumping water out from ballast tanks in the buoyant body 1. The pressure in the cylinders 39 and the tension in the tension legs 13 thereby will increase. The hydraulic cylinders 39 will in this case compensate possible vertical movements of the buoyant body 1. When sufficient tension is established in the tension legs 13, the connection between the cylinders 39 and the tank 40 is slowly chocked down by means of a valve 42. All vertical movements will now cease. At further deballasting of the buoyant body 1 and release of the pressure in cylinders 39 the buoyant body 1 will move upwards and contact is established between the upper connection 36 of the tension leg and the permanent load transmission bearing 41. The transmittance of the load to bearings 41 can be carried out with one leg for each column at a time.

The remaining legs will now be installed in the same fashion as described above although with the difference that the cylinders 39 only are used for subjecting the tension legs 13 to a preliminary pretensioning and in that the bearings 41 can be positioned only subsequent to that the tension 13 is given a preliminary pretensioning.

FIG. 11 shows a readily installed, tensioned leg 13.

The installation procedures are completed when panels 21 are lowered down into the grooves in the ribs 20. It is referred to FIGS. 9, 14, 15 and 15 which illustrate readily installed panels 21. The panels 21 are secured such that the knobs 49 on the panels 21 which are in engagement with the knobs 50, are not being forced out. The knobs are designed such as shown in FIGS. 14, 15 and 16 such that the panel 21 is positioned at higher level than its final position for subsequent lowering down into position wherein they will be supported by the faces or columns 51. The lifting lug 43 positioned at the top of the tension leg 13, is thereafter replaced with an inspection cover 44 and the tensioning equipment is disassembled.

If it is found necessary to protect the tension leg 13 and the columns 2 against bump loads in the wave zone 19 further to the provision of the panels 21, it can be expedient to provide the buoyant body 1 with an external collision ring 45 positioned in the wave zone 19. Such an externally positioned collision or bumper ring 45 is shown in FIG. 12. A such arrangement will simplify the partition of the walls 46 and the design of the decks 47 in the buoyant body 1 in that these decks not necessarily must be water tight. Thereby both building time and expenses may be reduced.

In an alternative embodiment the tension legs 13 are passed up through guide passages in the buoyant body 1. The panels 21 are with this solution permanent and not removable. The method for installation will then be as follows:

The tension leg 13, subsequent to being brought into vertical position, is pulled up through an opening, which can be a cylindrical passage formed by the ribs 20, the column 2 and the now installed panel 21. The attachment point of the tension leg to the fundament 16 ought to be higher against the sea bottom than the height of the rib 20 on the column 2 in order to avoid that the tension leg contacts the sea bed during installation/removal, or the link 18 may be such designed that the leg may be bent sufficiently in order to avoid dangerous contact with the sea bed 15. The rib 20, the panel 21 and the column 2 should on all exposed surfaces be covered with a material which prevents scraping or abrasion of the surface treatment of the tension leg 13. The upper connection 36 of the tension leg must be mounted on the tension leg subsequent to that same has been pulled up to correct position. The tension leg with this method will represent the only "movable" element during installation for removal of the said tension leg.

I claim:

1. A tension leg platform for sub sea operations comprising:

(a) a working platform positioned above sea level, (b) a buoyant body which is connected to the underside of the working platform and which extends below the sea surface, (c) a number of substantially rigid tension legs connecting the buoyant body under tension to the sea bottom, (d) means for attaching each of said tension legs to the buoyant body above the water line, (e) a plurality of guide means disposed vertically along said buoyant body at a submerged portion thereof, each said guide means defining a vertically extending, walled space for receipt of a portion of one of the tension legs and serving to pilot the tension leg into proper position against said buoyant body during the attaching of the leg to the body, (f) said leg portion including a section of enlarged cross-sectional area, (g) said guide means including an enlarged space complementary to said enlarged section for receipt thereof for restricting horizontal movement of the tension leg relative to said body.

2. A tension leg platform in accordance with claim 1, wherein said guide means are disposed on the outside of the buoyant body and each includes movable closure means adapted to be opened to permit lateral passage of a tension leg into and out of said guide means during the attaching of said leg to said body and the removal of said leg, respectively.

3. A tension leg platform in accordance with claim 1, wherein each of said tension legs comprises at least two members joined together by means of a link, said link comprising said tension leg portion enlarged section.

4. A platform according to claim 1, including enclosure means for each of said tension legs mounted on said buoyant body at the sea surface, said enclosure means each comprising vertically extending ribs extending outwardly from said body and a vertically extending panel mounted at the outwardly extending ends of said ribs for defining an enclosed, vertically extending space for each said tension leg.

5. A platform according to claim 4 wherein one side of said panel extends into a vertically extending slot within one of said ribs for retaining said panel in position.

6. A method for installation of a tension leg platform within the sea, the platform comprising a buoyant body including means for controlling the ballasting thereof, and tension legs having connecting means mounted on load bearing members on said body for anchoring said body in place, said method comprising:

(a) attaching one end of each of a plurality of tension legs to a fundament anchored to the sea bottom, (b) attaching the other end of each of said tension legs to a different one of hydraulic cylinders mounted on said buoyant body, and pressurizing said cylinders for stretching said tension legs to tension them and to position the connecting means thereon above said load bearing members, (c) deballasting the buoyant body to cause upward movement thereof for further tensioning said tension legs, and when a sufficient tension in said tension legs is reached to prevent vertical movement of said body in response to wave action, depressurizing said hydraulic cylinders in synchronization with further deballasting of said body until said load bearing members are brought into load bearing contact with said connecting means.

7. A method for installation in accordance with claim 6, wherein, subsequent to attaching the tension legs to the fundament, pulling the other end of each said of tension legs into a slit-shaped opening on the outside of the buoyant body, and securing said legs within said openings with locking plates prior to the tensioning of said legs.

8. A method for installation in accordance with claim 6, including pulling the tension legs up through a hollow protectional structure on the outside of the buoyant body.

9. A method for installation in accordance with claim 6 including, subsequent to attaching the legs to the fundament, pulling the other end of each said legs into a vertically extending space defined by a pair of spaced apart vertically extending ribs mounted on said body and extending outwardly therefrom, and, after each said leg is positioned within its space, lowering a panel downwardly within vertically extending grooves within said ribs for enclosing each said space and the tension leg therewithin.

10. A method for installation according to claim 6 including transporting prefabricated ones of said legs to the installation site in a substantially horizontal position, and from said horizontal position, guiding said one end of each of said legs downwardly towards the fundament prior to positioning said other end of said leg against said body.

11. A method for installation according to claim 10, including guiding said one end downwardly by means of a cable passing through a portion of said fundament.

* * * * *